US006058284A

United States Patent [19]

Okano et al.

[11] Patent Number: 6,058,284

[45] Date of Patent: May 2, 2000

[54] DEVELOPING APPARATUS

[75] Inventors: Keiji Okano, Tokyo; Kouichi Suwa, Ushiku; Seiji Yamaguchi, Numazu; Hideki Matsumoto, Susono, all of Japan

[73] Assignee: Canon Kabushiki Kaisha, Tokyo, Japan

[21] Appl. No.: 09/022,525

[22] Filed: Feb. 12, 1998

[30] Foreign Application Priority Data

Feb. 17, 1997 [JP] Japan ..... 9-032000

[51] Int. Cl.[7] ..... G03G 15/08; G03G 21/16

[52] U.S. Cl. ..... 399/284; 399/111

[58] Field of Search ..... 399/284, 274, 399/273, 283, 111

[56] References Cited

U.S. PATENT DOCUMENTS 4,458,627 7/1984 Hosono et al. ..... 399/274
5,068,691 11/1991 Nishio et al. ..... 399/284

*Primary Examiner*—Susan S. Y. Lee
*Attorney, Agent, or Firm*—Fitzpatrick, Cella, Harper & Scinto

[57] ABSTRACT

A developing apparatus includes a developer carrying sleeve, opposed to an electrostatic image bearing member for carrying a developer; a regulating member for regulating an amount of developer on the developer carrying sleeve, wherein the regulating member cooperates with the developer carrying member to form a nip, and includes a rubber blade having a wear index of 0.03–0.15, and wherein the rubber blade is contacted to the developer carrying member with a contact pressure P (g/cm), wherein $10 \leqq P \leqq 60$.

10 Claims, 4 Drawing Sheets

DEVELOPING APPARATUS

FIELD OF THE INVENTION AND RELATED ART

The present invention relates to a developing apparatus, which is employed in an electrophotographic or electrostatic image forming apparatus to develop electrostatic images on an image bearing member.

In an image forming apparatus which employs an electrophotographic system, electrostatic latent images formed on an image forming member are developed into visual images with the use of a developing apparatus. There is a developing apparatus which uses a single component dry toner, currently in practical use.

Presently, the printer market is dominated by LED printers 1 laser beam printers, and the like, and the printer technologies are aimed at high resolution, for example, 600 dpi, 800 dpi and 1200 dpi. Demand is increasing for a highly precise developing system capable of realizing such high resolution.

As for a fixing apparatus which fixes toner images to recording medium after the toner images are deposited on the recording medium, a contact type heating apparatus is desirable from the standpoint of saving energy and reducing printing time. Since they are outstanding in thermal efficiency, they can take advantage of a reduced fixing temperature, being therefore outstanding in terms of operational safety.

As for toner, in order to improve toner image fixation to a recording medium, (in order to make it possible to fix toner images at a relatively low temperature), the thermal properties of a binder or wax are improved so that toner is improved in terms of elasticity in the melted condition.

Further, in order to improve image quality, efforts have been made to reduce the diameter of the toner particles. For example, in order to increase resolution or sharpness so that latent images are developed with greater fidelity, toner with a particle diameter of approximately 6–9 $\mu$m has been used. Also in order to improve image quality, developing methods which employ an elastic blade or the like have been put to practical use, in which a blade composed of elastic material has been employed in a developing apparatus, and this elastic blade has been placed in contact with a development sleeve to regulate the amount of the toner to be layered on the development sleeve, and also to triboelectrically charge the toner. Further, in order to charge the toner more uniformly, methods for reducing the amount of the toner to be coated on the development sleeve are being developed.

In the past, however, when toner which was composed of toner particles with a smaller diameter, being thereby better in fixation, was used along with a developing apparatus which employed an elastic blade, durability became a problem.

Since the toner composed of particles of smaller diameter is likely to be better charged than the toner composed of particles of larger diameter, its electrostatic adhesion to the development sleeve is likely to be stronger, being liable to soil the peripheral surface of the development sleeve. Further, such toner particles are liable to fuse with each other when the toner is subjected to external forces, for example, at the contact nip where the blade meets the peripheral surface of the development sleeve. If the fusing of the toner particles occurs at the contact nip, unwanted lines, or streaks, appear across the image. This problem was more liable to occur when the contact pressure between the blade and the development sleeve is high, the ambient temperature and humidity is high, printing speed is high, and/or in the like situations, than otherwise.

SUMMARY OF THE INVENTION

Accordingly, an object of the present invention is to provide a developing apparatus capable of preventing toner particles from fusing with each other at the contact nip where a blade contacts the peripheral surface of a development sleeve.

Another object of the present invention is to provide a developing apparatus which employs a blade capable of properly rubbing toner particles.

Another object of the present invention is to provide a developing apparatus which comprises: a developer carrying member which carries developer, and is disposed in such a manner that the developer carrying surface thereof squarely faces the peripheral surface of a member on which electrostatic images are formed; and a regulating member which regulates the amount of developer layered on the peripheral surface of said developer carrying member; wherein said regulating member forms a nip, along with said developer carrier, and comprises a rubber blade, the coefficient of friction of which is in a range of 0.03–0.15, and wherein the contact pressure P (g/cm) between said rubber blade and said developer carrying member is as follows:

$$10 \leqq P \leqq 60.$$

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 6:
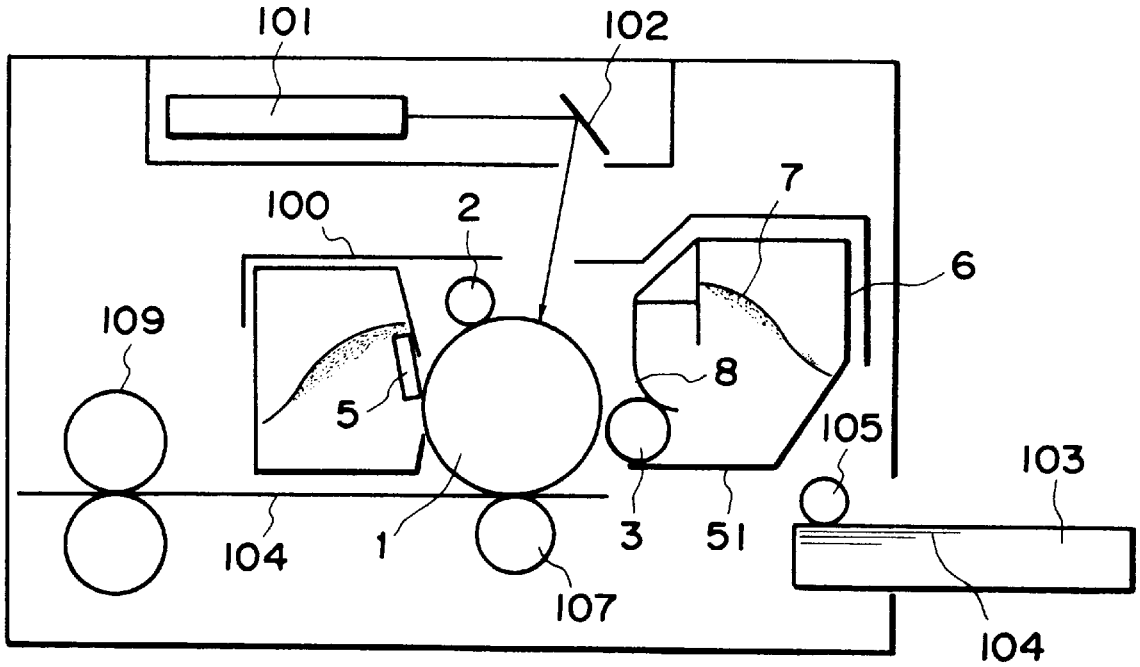
FIG. 6 is a sectional view of an image forming apparatus in accordance with the present invention.

FIG. 6 is a sectional view of an electrophotographic laser beam printer, that is, an image forming apparatus, which employs a developing apparatus in accordance with the present invention. It depicts the general structure of the printer.

A referential FIG. 1 designates an electrophotographic photosensitive member (hereinafter, "photosensitive drum"), which uses organic photoconductor. The rotational speed (hereinafter, "process speed") of the photosensitive drum is 100 mm/sec. The peripheral surface of the photosensitive drum 1 is uniformly charged by a roller type charging device 2, and then is exposed to a laser beam emitted, being modulated by image signals, by a laser beam scanner; more specifically, the laser beam emitted from a semiconductor laser of the laser scanner 101 is reflected by a polygon scanner, being thereby made to move in a scanning manner, and then is focused on the peripheral surface of the photosensitive drum 1 by an optical system of the laser scanner 101. As a result, an electrostatic latent image is formed, which is developed by a developing device 6 using a given developing method, for example, a jumping developing method. The developing device 6 adheres toner to the peripheral surface of the photosensitive drum 1, on the areas where the charge has been removed by the exposure; in other words, the latent image is developed in reverse.

The developed image is transferred onto a sheet of transfer material 104, which is individually delivered by a sheet feeder roller 105 from a cassette 103 in which a plurality of the sheets of transfer material are stored. More specifically, upon reception of a printing signal from a host, the sheet of transfer material 104 is fed by the sheet feeder roller, and the developed image, that is, the toner image, is transferred onto the sheet of transfer material by a transfer roller 107. The transfer roller 107 is composed of electrically conductive elastic material, and forms, along with the photosensitive drum 1, a nip in which the toner image is electrostatically transferred by an electric field with a predetermined bias.

After being transferred onto the sheet of transfer material, the toner image is fixed to the sheet of transfer material by a fixing device 109. Meanwhile, the photosensitive drum 1 is cleaned by a cleaner; the toner particles which remain on the photosensitive drum 1 are removed by the blade 5 of the cleaner.

Figure 1:
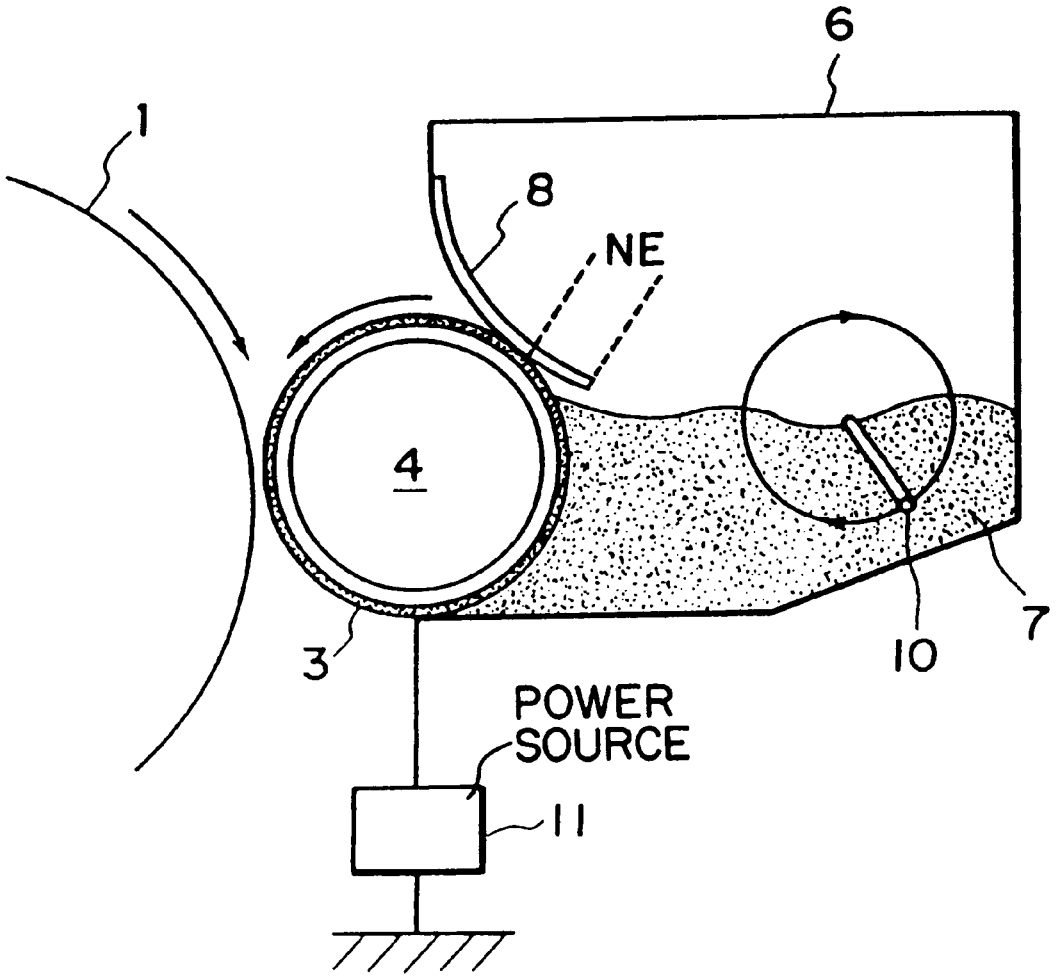
FIG. 1 is a sectional view of the developing apparatus in an embodiment of the present invention.

FIG. 1 is a sectional view of the developing apparatus in the first embodiment of the present invention.

A development blade 8 composed of elastic material is a member for regulating developer. A development sleeve 3 is a developer carrier. In the developing apparatus, the development blade 8 is placed in contact with the development sleeve, forming a nip in which the amount of the toner to be coated is regulated.

The development sleeve 3 comprises a non-magnetic aluminum cylinder with a diameter of 16.0 mm, and a layer of resin material coated on the peripheral surface of the aluminum cylinder. The coated resin layer contains electrically conductive particles. The roughness (Ra) of the surface of the development sleeve 3 is 1.0 $\mu$m (Ra=1.0 $\mu$m).

The development blade 8 is composed of silicone rubber with a hardness of 40 deg. (JISA). It is attached to the developer container in such a manner that the contact pressure (P g/cm: contact pressure per one centimeter in the longitudinal direction of the sleeve) between the development blade 8 and the development sleeve 3 becomes 40 g/cm. The width (in the direction perpendicular to the longitudinal direction of the sleeve) of the nip is 1.0 mm, and the distance (hereinafter, "NE") between the upstream edge of the nip, relative to the rotational direction of the sleeve, and the free end of the blade is 2.0 mm.

In the development sleeve 3, a magnetic roller 4 is fixedly disposed. In the developer container, single component magnetic toner 7 is contained. The toner 7 is moved to the adjacencies of the development sleeve as it is stirred, and then is adhered to the development sleeve 3 due to the presence of the magnetic field formed by the magnetic roller 4. Next, as the development sleeve 8 is rotated, the toner adhered to the development sleeve 3 is carried by the development sleeve 3, and meets the development blade 8 at the nip. In the nip, the thickness of the toner layer is regulated, and also, the toner is triboelectrically charged while being regulated in thickness. Thereafter, the toner is carried to a development station. The amount W (W: weight of the toner in milligram per square centimeter of the surface of the sleeve 3) of the toner carried on the sleeve 3 is 1.20 mg/cm$^2$ (W=1.20).

To the development sleeve 3, an alternating compound voltage composed of a direct current voltage and an alternating current voltage is applied from an electrical power source 11, whereby an electrical development field is formed between the photosensitive drum 1 and the development sleeve 3. The electrostatic latent image is developed by this electric field. The DC current voltage applied to the development sleeve 3 is −500 V (Vdc=−500 V). The AC voltage applied to the development sleeve 3 has a rectangular waveform, a peak-to-peak voltage (Vpp) of 1600 V, and a frequency (f) of 1800 Hz. The closest distance between the peripheral surfaces of the development sleeve 3 and the photosensitive drum 1 is 300 $\mu$m. As the alternating compound voltage is applied to the development sleeve 3, the photosensitive drum 1 is uniformly charged to −700 V (Vd). Then, the uniformly charged surface of the photosensitive drum 1 is exposed to the laser beam modulated with image signals. As a result, the voltage (V1) of the exposed areas change to −150 V, and these areas with the voltage of −150 V are developed in reverse with the use of negatively charged toner.

The toner 7 is negatively chargeable single component magnetic toner. It is produced in the following manner. First, 100 parts, in weight, of copolymer of styrene-n-butyl acrylate (bonding resin), 80 parts of magnetic particles, 2 parts of monoazoic iron complex (agent for controlling negative charge), and 3 parts of low molecular weight polypropylene (wax), are melted and kneaded with the use of a double axle extruder heated to 140° C. Then, after cooling, the mixture is crushed by a hammer mill, and the crushed mixture is pulverized into microscopic particles by a jet mill. The thus obtained microscopic particles are separated according to diameter with the use of a blower, obtaining particles with a weight average diameter of 5.0 $\mu$m. The thus obtained particles are mixed with 1.5 parts of microscopic powder of hydrophobic silica with the use of a Henschel mixer, obtaining the developer in accordance with the present invention. The fixation index, or melt index, MI is 20. The toner in accordance with the present invention has an MI of 13–30, and a weight average diameter of 3.5–7.0 $\mu$m.

The development blade is formed in the following manner. First, a piece of 60 $\mu$m thick stainless steel plate coated with primer for silicone is set in a preheated mold. Then, LTV silicone rubber is injected into the mold from an LIM injection molding machine. After being heated for five minutes at 150° C., the development blade 8 is removed from the mold, and then is thermally treated for four hours at 200° C. The thus obtained silicone rubber blade has a hardness of 40 deg.

When the above-described printer was tested under various conditions: normal temperature—normal humidity condition (25° C., 60% RH), low temperature—low humidity condition (15° C., 10% RH), and high temperature—high humidity condition (30° C., 80% RH), high quality prints could be constantly obtained.

Hereinafter, the present invention will be described in detail.

Test 1

Relationships between toner MI and streaks, and between particle diameter and streaks The printer used in this test was basically the same as described above, except for the blade material, which was urethane rubber. In the test, the toner MI and the toner particle diameter were varied to examine the toner fixation, image development, and blade durability. The test conditions were as follows:

Blade: urethane rubber (hardness: 65 deg.); contact pressure P=40 g/cm; NE=2.0 mm Sleeve: electrically conductive resin Toner: Ra=1.0 $\mu$m W=1.20 mg/cm$^2$ The MI of the toner was changed by means of changing the molecular weight of the binder. Also, the average particle diameter of the toner was changed by means of changing the condition under which toner particles were separated according to diameter.

Melt index (MI) was measured using the apparatus in accordance with JIS K7210 and a manual cutting method, under the following condition. The obtained value was converted into values in ten points scale.

Test conditions

Temperature: 125° C.; Load: 5 kg;

Amount of the toner: 5–10 g

The average diameter of the toner was measured with the use of a Colter multi-sizer II (product of Colter Co.); the weight average diameter D4 ($\mu$m), that is, weight index, was obtained from the volumetric distribution of the toner particles.

Table 1 shows the results of the evaluation of each toner, regarding the various aspects of the produced images, which will be described later.

TABLE 1

| TONER | MI | PARTICLE SIZE | FIXING | IMAGE QUALITY | DURABILITY |
|---|---|---|---|---|---|
| I | 15 | 5.0 | G | E | NG |
| II | 15 | 8.0 | G | F | F |
| III | 1 | 5.0 | NG | E | F |
| IV | 1 | 8.0 | NG | F | G |

Described below are the evaluated aspects of the images.

1) Image quality: sharpness of characters

Images of sample characters were formed, and the formed images were evaluated under thirty times magnification, using the following classification.

E (excellent): lines are extremely sharp, with virtually no scattering of toner.

G (good): lines are relatively sharp, with the presence of a small amount of scattered toner.

F (fair): lines are dull, with the presence of a larger amount of scattered toner than the above.

NG (no good): below the F level.

2) Fixation

A fixed toner image is rubbed with a thin sheet of soft paper while applying a load of 50 g/cm$^2$. Then, rate (%) of image density reduction was obtained by comparing the image densities before and after the rubbing. The image density was measured using a Macbeth reflection densitometer (product of Macbeth Co.)

E: less than 5%

G: no less than 5% and less than 10%

F: no less than 10% and less than 20%

NG: no less than 20%

3) Durability

Ten thousand prints were produced at a printing speed of 4 prints per minute under various conditions: normal temperature—normal humidity condition (25° C., 60% RH), high temperature—high humidity (32° C., 90% RH), and low temperature—low humidity condition (10° C., 15% RH). The above table shows the evaluation with reference to the streaks.

G: no streak

F: virtually undetectable

NG: conspicuous white streaks

The fixation is related to the toner MI, and when the MI is in a range of 3–30, desirable fixation is realized. When the MI is less than 3, the fixation is bad, and when it exceeds 30, toner is liable to suffer from high temperature offset.

Image quality is related to toner particle diameter, and is better when the toner particle diameter is in a range of 3.5–7.0 $\mu$m. When the toner particle diameter is less than 35 $\mu$m, the toner is liable to be charged too much, which results in poor image development, and when it exceeds 7.0 $\mu$m, the appearances of lines and dots become poor.

However, it became evident that increasing the toner MI and/or decreasing toner particle diameter reduces the blade durability. Also it was found that the streaks occurred due to the following causes.

The streaks were caused as the toner particles were caked in the nip. These caked toner grew to sizes as large as 200 $\mu$m in diameter. As for the cause for such toner caking, it is possible that toner particles were partially melted due to the pressure from the blade and the resultant frictional heat, and then grew to large particles, or granules (caking).

More specifically, there are two thoughts about the cause of the toner caking, which are as follows. First, the smaller the toner particle diameter is, the more liable the toner is to aggregate, and therefore, get stuck in the nip. Second, the larger the MI is, the more liable heat is to be accumulated in the toner particles, and therefore, the more liable the additive is to be buried in the toner particle, failing to prevent the toner particles from aggregating. Also, the larger the MI is, the more liable the toner particles are to be melted by heat.

As for the operational environment, the higher (32° C., 90% RH) the temperature and humidity, the more liable the streaks will to appear.

Test 2

Relationships between blade material and streaks, and between blade pressure and streaks Next, the relationship between the streaks and the blade material, and the relationship between the streaks and the blade pressure, were investigated under the condition in which the toner had a MI in the range of 3–30 and a particle diameter of 3.5–7 $\mu$m, and in which temperature and humidity were kept at 32° C. and 90% RH, respectively, to prolong the service life of the blade. The results of the test are given below.

The test conditions were the same as those used in the first test, in which the sleeve had an Ra of 1.0 $\mu$m, and the toner had an MI of 15, and a particle diameter of 5.0 $\mu$m.

The hardness of the blade was varied by means of using different rubber materials. The NE of the blade was set at about 2.0 mm; it was adjusted so that the coated amount W of toner becomes approximately 1.2 g/cm$^2$. The blade pressure was adjusted by means of changing the thickness of the rubber.

In the second test, the sleeve was continuously idled in a high temperature - high humidity environment to determine the time it took for streaks to appear, so that the conditions under which streaks appear could be clarified. The relationship between the idling time and the actual printing time shows that when a given blade did not cause streaks after ten hours of idling, it was good for producing at least 10,000 prints.

Figure 2:
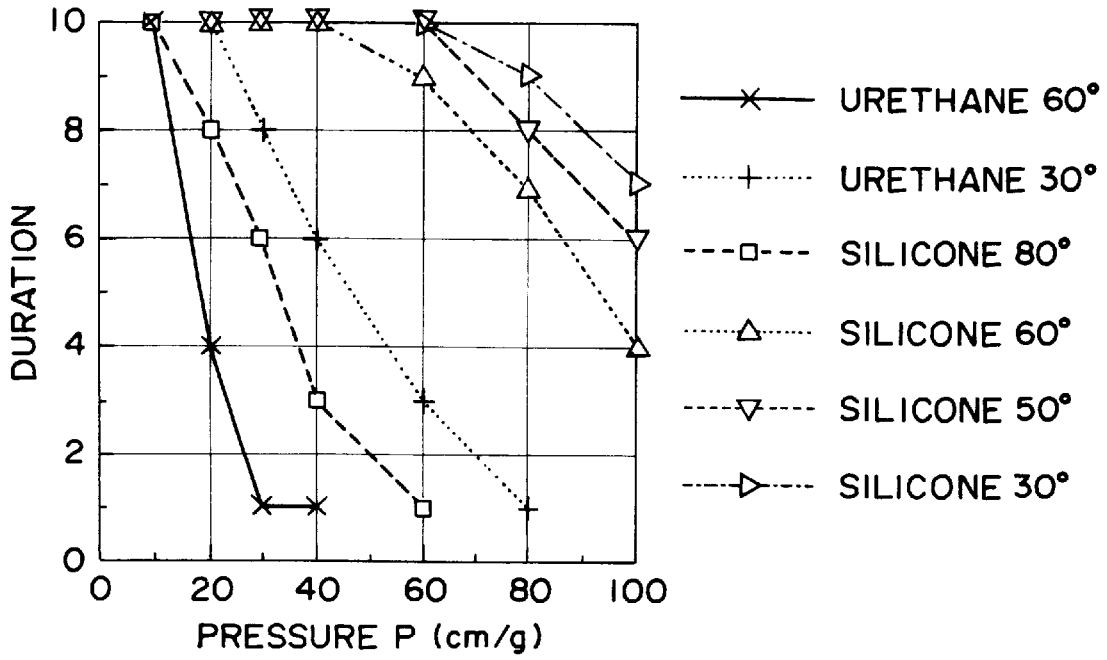
FIG. 2 is a graph which shows the results of the test conducted using the developing apparatus in the embodiment of the present invention.

The results were given in FIG. 2, which verifics the following.

1) When the contact pressure P is small, for example, no more than 10 g/cm, streaks do not occur.
2) The less the hardness of the rubber, the less liable the streaks are to appear. This may due to the following reason. That is, the less the hardness of the rubber, the larger the nip width becomes, and therefore, the contact pressure per unit area in the nip becomes smaller, provided that the pressure applied to the blade remains the same, which makes it easier for the toner particles to pass through the nip, hence, the toner particles are less liable to aggregate, or to cake.
3) As for the blade material, silicone rubber is the best in terms of preventing the streaks. This may be due to the fact that silicone rubber is more likely to be worn away by friction, being less likely to promote the toner particles to cake.

More specifically, in the case of a blade composed of silicone rubber with hardness of a low level, even when the pressure applied to the blade is relatively large, the nip grows, and therefore, the contact pressure per unit area in the nip becomes smaller, as the blade is worn by friction. Thus, when a blade is composed of silicone rubber, it is less liable to cause streaks.

Based on the above findings, silicone rubber was subjected to more tests which examined the effects of wear index, that is, one of the rubber properties, upon occurrence of streaks; and in which the wear index of silicone rubber was varied by means of changing the materials for silicone rubber.

More specifically, the hardness of the silicone rubber was varied by means of changing the weight ratio of silica, the filler, to rubber, and also changing the number of cross-linking points of the rubber.

Streaks were examined in the same manner as described above, with the blade pressure being set at 40 g/cm.

The results are given in Table 2.

TABLE 2

| | Rubber 1 | Rubber 2 | Rubber 3 | Rubber 4 |
|---|---|---|---|---|
| Hardness JISA (deg.) | 30 | 65 | 30 | 30 |
| Filler (%) | 0 | 0 | 30 | 20 |
| Wear index (mg) | 0.035 | 0.012 | 0.18 | 0.14 |
| Wear amount ($\mu$m) | 15 | 4 | 23 | 20 |
| Nip width (mm) | 1.3 | 0.8 | 1.8 | 1.6 |
| Streaks by caking | G | NG | G | G |
| Streaks by blade defect | G | G | NG | G |

The wear index was measured using a test in accordance with JIS K6464.

THe values of blade abrasion, and the resultant change in nip width, in Table 2 were obtained by means of measuring the cross section of the blade with the use of a surface roughness tester after the sleeve was rotated for 20 hours.

In the table the streaks caused by the caked toner particles are the same as those described above. The streaks caused by the irregular wear, or chipping, of the blade are those attributable to nonuniform coating of toner which is traceable to the unevenness in nip width caused by the irregular wear, or chipping, of the blade.

The following are the discoveries made from the test.

1) Also in the case of silicone rubber, the greater the hardness, the smaller the nip width and the wear index, and therefore, (1) the contact pressure per unit area of the interface between the blade and the sleeve is larger compared to a case in which the hardness of the silicone rubber is less, hence the toner particles are caused to cake in the nip, which in turn produces while streaks, (2) although toner particles do not stick to the blade because the blade is composed of silicone rubber (rubber 2 in the table).
2) A blade composed of silicone rubber with hardness of a lower level is greater in wear index. Therefore, it is acceptable as far as the streaks attributable to toner caking are concerned (rubber 1, 3 and 4).
3) A blade composed of silicone rubber in which the amount of filler is relatively large is liable to be unevenly worn, or chipped, which causes the surface of the coated toner layer to be uneven, and this uneven surface of the coated layer produces streaks (rubber 3).

As for the results of the test which involved various types of rubber, it was discovered that the use of a type of silicone rubber, the wear index of which is in a range of 0.03–0.15, is effective to prevent the occurrence of streaks; if the wear index is smaller than 0.03, the blade is liable to produce the streaks attributable to toner caking, and if the wear index is greater than 0.05, the blade is liable to produce the streaks attributable to the uneven wear of the blade.

As for the formula for the silicone rubber, it was found to be desirable that filler content was 5–20 parts, and the hardness of the rubber was set to be in a range of 10–55 deg. by adjusting the number of cross-linking points.

As a blade wears, the nip size increases, and consequently the NE decreases. But, in this embodiment, the effect of the blade wear upon the amount of the toner coated on the sleeve was small.

In other words, in the case of a blade composed of silicone rubber with low level hardness, the higher the blade contact pressure, the more it wears, and the more it wears, the larger the nip becomes, hence the contact pressure per unit area of the nip becomes smaller, canceling the effect of the higher linear contact pressure. Therefore, a blade composed of silicone rubber with low level of hardness is less liable to cause streaks.

Figure 3:
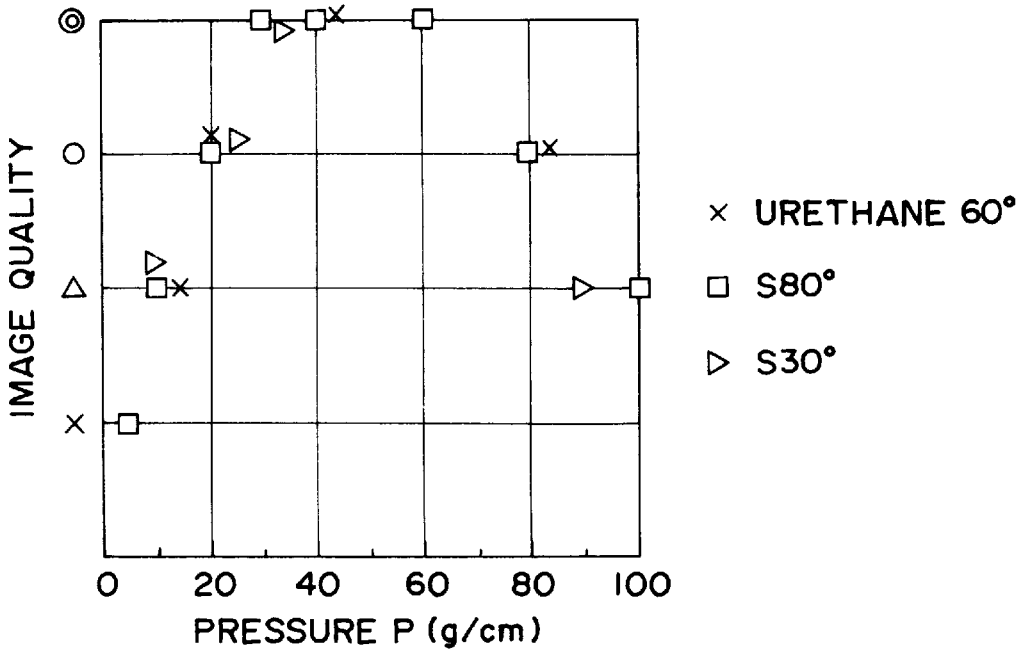
FIG. 3 is a graph which shows the results of the test conducted using the development apparatus in another embodiment of the present invention.

The results of the study of the relationship between the contact pressure of the blade, and image quality, which was examined in this Test 2 are given in FIG. 3.

1) Practically, image quality is determined by the contact pressure of a blade.

It is desirable that the contact pressure between a blade and a sleeve is in a range of 10–60 g/cm. When the contact pressure is less than 10 g/cm, the toner is insufficiently charged, which causes the toner to scatter, and as a result, lines become blurry. When the contact pressure is greater than 60 g/cm, a smaller amount of toner is coated, and therefore, lines are liable to break up as printing continues.

2) The effect of a difference in hardness of a blade upon image quality is small.
3) The effect of a difference in blade material (urethane and silicone) upon image quality is also small.

The above results led the inventors of the present invention to the following conclusion.

Even when images are formed using developer, the MI of which is in a range of 3–30, and the weight average particle diameter of which is in a range of 3.5–7.0 $\mu$m, and also using an elastic blade as a developer regulating member to coat the developer, as long as the elastic blade is composed of silicone rubber, the hardness of which is no less than 10 deg.

and no more than 55 deg. in the JISA scale, the blade wears at a proper rate, and therefore, the nip formed at a point where the blade contacts the development sleeve becomes wider, which in turn reduces local pressure. In other words, the occurrence of streaks is prevented as the blade wears off at a proper rate. As a result, high quality images can be produced throughout the service life of the blade.

Figure 4:
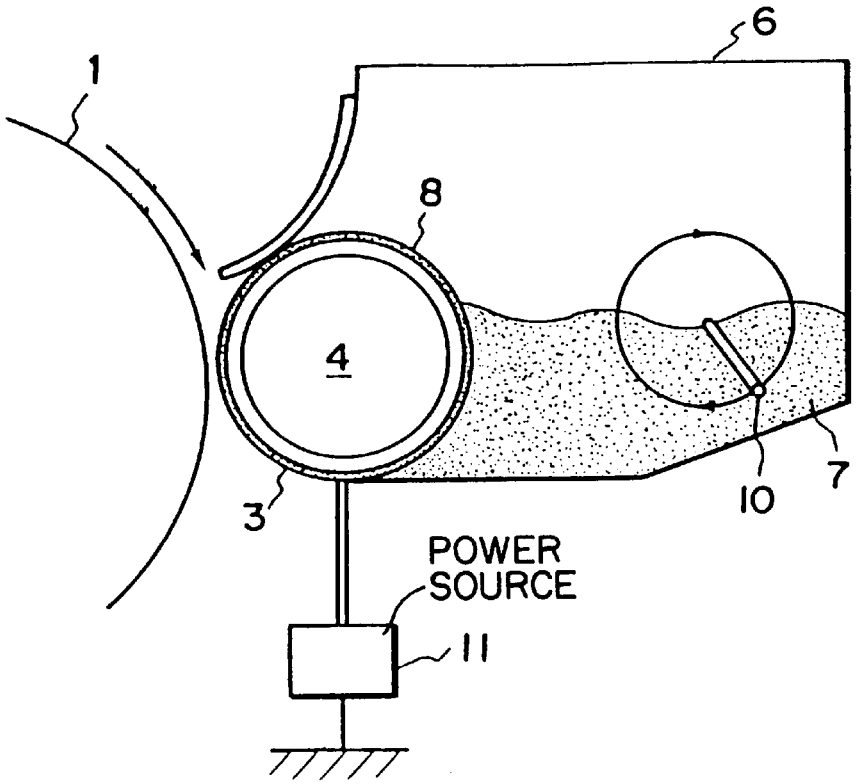
FIG. 4 is a sectional view of the developing apparatus in another embodiment of the present invention.

In this embodiment, the blade was placed in contact with the development sleeve in such a manner that the free end of the blade is located on the downstream side relative to the development sleeve rotation, but the present invention is also compatible with such a blade setup that the free end of the blade is located on the upstream side of the sleeve rotation as illustrated in FIG. 4.

Further, the present invention is also compatible with a simple sleeve which is formed of nonmagnetic metal such as aluminum, and the surface of which is simply roughened instead of being coated with a resin layer containing electrically conductive particles. However, when a sleeve such as the one employed in this embodiment is employed, a stable toner layer can be reliably formed.

Further, in this embodiment, the peripheral velocity of the development sleeve is 100 mm/sec, but it is desirable that the present invention is applied to a process cartridge, the development sleeve of which has a peripheral velocity of no more than 250 mm/sec, and the developing device of which has a service life of no more than 15,000 sheets.

Embodiment 2

This embodiment is such that image quality is further enhanced. In the case of a developing apparatus in which a blade is placed in contact with a development sleeve in a manner to counter the rotational direction of the sleeve, a toner layer is reliably formed. In the case of such a developing apparatus, the pressure and the NE of the blade, and the roughness of the sleeve surface, are the major factors that determine how much toner is coated on the sleeve.

In this embodiment, an apparatus in which a toner layer is reliably formed on a development sleeve at the aforementioned weight ratio W of no less than 0.6 mg/cm$^2$ and no more than 1.5 mg/cm$^2$ will be described. When W is less than 0.6 mg/cm$^2$, there is a possibility that streaks appear as the apparatus usage is prolonged. When W is more than 1.5 mg/cm$^2$, image quality is poor.

Test

The toner and the sleeve used in this test were the same as those used in the first embodiment. In other words, toner I was used, and the surface of the sleeve was coated with a resin layer containing electrically conductive particles, and had an Ra of 1.0 $\mu$m (Ra=1.0 $\mu$m). The blade was an elastic blade composed of silicone rubber with a hardness of 40 deg., and was placed in contact with the sleeve in the counter direction relative to the rotational direction of the sleeve.

The toner layer formation, image quality, and blade durability were evaluated in the same manner as they were in the first embodiment while varying the blade pressure and the NE. The blade pressure, or contact pressure, was adjusted by changing the thickness of the blade, and the NE was adjusted by changing the length of the flexible portion of the blade.

Figure 5:
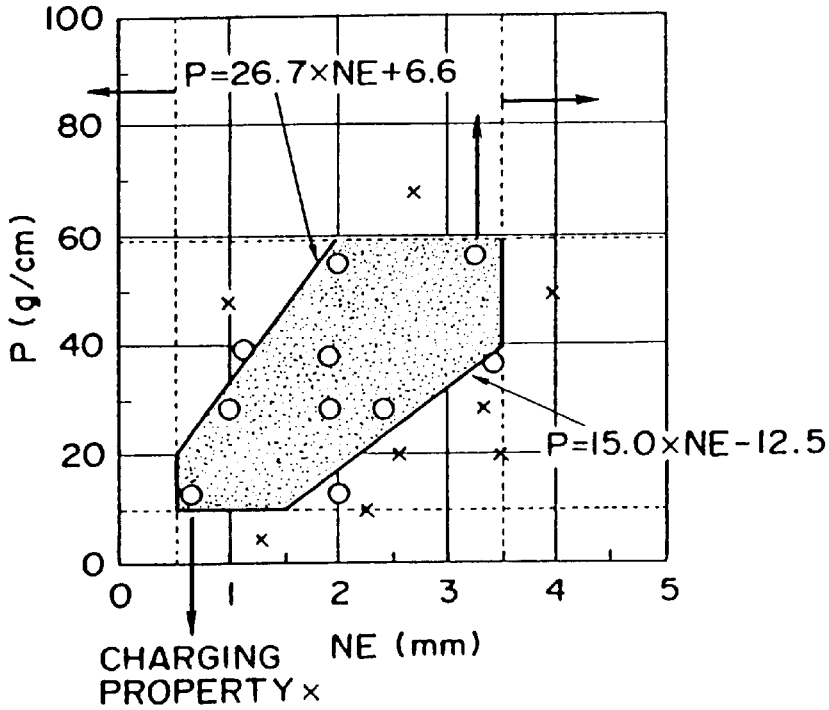
FIG. 5 is a graph which shows the effects of the developing apparatus in the second embodiment of the present invention.

The results are given all together in FIG. 5.

It became evident from the test that there are the following relationships between the condition of blade contact and image quality, and between the condition of blade contact and blade durability:

1) When the NE is less than 0.5 mm, the blade edge sometimes makes contact with the sleeve, and as the blade edge contacts the sleeve surface, the W (weight of toner per unit area in the nip) is excessively reduced, which causes images to suffer from low density and/or white spots. On the contrary, when the NE is more than 3.5 mm, an excessive amount of toner is coated on the sleeve, degrading thereby image quality, and also, the blade fails to reliably regulate the toner layer, allowing the toner layer to become nonuniform.
2) When the blade pressure P is less than 10 g/cm, toner is insufficiently charged, which results in poor image quality inclusive of insufficient density. On the contrary, when the blade pressure P is more than 60 g/cm, which is too high, toner is coated on the sleeve only by an excessively small amount, which causes lines to break up, and sometimes causes streaks to appear, as the cumulative time of blade usage increases.
3) It was also discovered that there is the following relationship between the P and the NE.

That is, when the P is small, the force which regulates toner is small. Therefore, unless the NE is reduced, an excessively large amount of toner is coated on the sleeve, and at the same time, toner layer formation by a blade becomes unstable, which results in the formation of a nonuniform toner layer. On the contrary, as the P is increased, the toner regulating force increases to a sufficient level, and therefore, the NE should be larger since the larger the NE, the more stable the toner coat, satisfying thereby both image quality and blade durability.

The results of this test can be expressed by the following formula:

$$15.0\times NE-12.5\leqq P\leqq 26.7\times NE+6.6.$$

In other words, when the P and the NE satisfy the following three relationships, a stable toner layer is formed:

$$10\leqq P\leqq 60$$

$$5\leqq NE\leqq 3.5$$

$$15.0\times NE-12.5\leqq P\leqq 26.7\times NE+6.6.$$

Further, with the change in roughness of the sleeve surface, the amount of toner coated on the sleeve surface changed. However, it became evident that as long as the Ra was no less than 0.6 $\mu$m and no more than 1.4 $\mu$m ($0.6\leqq Ra\leqq 1.4$), and the condition of the blade was set up so that the P and the NE satisfied the above formulas, the toner layer could be formed so that the W on the sleeve surface became no less than 0.8 mg/cm$^2$ and no more than 1.5 mg/cm$^2$ ($0.8\leqq W\leqq 1.5$).

As described above, in this embodiment, even when the amount W (weight of the toner in the toner layer per square centimeter of the sleeve surface) of the developer in the developer layer formed on the developer carrying member was set to be no less than 0.8 mg/cm$^2$ and no more than 1.5 mg/cm$^2$ ($0.8\leqq W\leqq 1.5$) in order to further improve image quality, streaks do not appear, and therefore, high quality images can be formed for the service life of the blade.

Embodiment 3

This embodiment is unique in that a developing apparatus such as the one described in the preceding embodiment is integrally disposed, along with a photosensitive drum, a cleaner, a charging apparatus, and the like, in an exchangeable cartridge.

Figure 7:
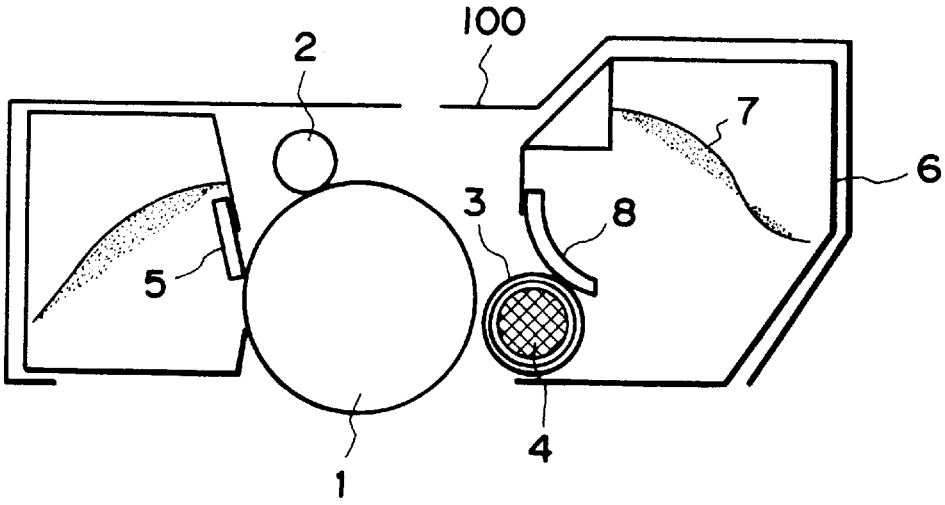
FIG. 7 is a sectional view of the cartridge in the third embodiment of the present invention.

FIG. 7 depicts an example of an image forming apparatus which employs such an exchangeable cartridge. In the drawing, the components which have the same structure as those in the image forming apparatus described in the preceding embodiments are designated with the same referential codes as those used in the preceding embodiments. In this embodiment, a developing apparatus 6, a photosensitive drum 1, a cleaning apparatus 5, and a charging apparatus 2 are integrally disposed in a case 100 to form a cartridge. This cartridge is designed so that all the apparatuses and components integrated into the cartridge reach the ends of their service lives at about the same time as toner 7 completely runs out. Therefore, a user can except that as long as there remains toner in the cartridge, high quality images can always be obtained. In addition, being integrated into a cartridge is advantageous in terms of being easily exchangeable. Thus, an image formation cartridge which employs a developing apparatus in accordance with the present invention not only enjoys the inherent advantage of being a cartridge, that is, being easily exchangeable, but also enjoys the advantage of the present invention, that is, being able to reliably form highly precise images for a long period of time.

As described above, according to the present invention, the occurrence of streaks can be prevented as the rubber wears at a proper rate, and therefore, high quality images can be formed for a long period of time.

Since silicone rubber, the hardness of which in the JISA scale is no less than 10 deg. and no more than 55 deg., is used as the material for a development blade, the width of the nip at the contact between the development blade and a development sleeve is wider compared to a development blade composed of the harder material, and therefore, the local pressure in the nip is smaller, hence streaks are less liable to occur.

Further, even when the amount W of toner in the toner layer formed on the peripheral surface of a developer carrying member (W: amount of toner in milligram per square centimeter of the peripheral surface of a development sleeve) is set at a rate no less than 0.8 $mg/cm^2$ and no more than 1.5 $mg/cm^2$ in order to further improve image quality, streaks do not occur, and therefore, higher quality images can be formed throughout the service life of a development sleeve.

Further, the condition of blade contact is set so that a blade is disposed in a manner to counter the rotational direction of a development sleeve, and so that the contact pressure P (pressure per unit length: g/cm), and the distance NE (mm) from the upstream edge of the nip to the free end of the blade, satisfy the following relationships:

$$10 \leqq P \leqq 60$$

$$5 \leqq NE \leqq 3.5$$

$$15.0 \times NE - 12.5 \leqq P \leqq 26.7 \times NE + 6.6.$$

Therefore, a stable toner layer is formed.

Further, a developer carrying member has a surface layer of resin material which contains electrically conductive particles, and the center line average height Ra ($\mu$m) of the surface of the resin layer is no less than 0.6 $\mu$m and no more than 1.4 $\mu$m. Therefore, a stable toner layer is formed.

Lastly, since a process cartridge in accordance with the present invention is disposable, high quality is maintained.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer carrying member, opposed to an electrostatic image bearing member for carrying a developer;

a regulating member for regulating an amount of developer on said developer carrying member;

wherein said regulating member is contacted to said developer carrying member, and includes a rubber blade having a wear index of 0.03–0.15, and wherein said rubber blade is contacted to said developer carrying member with a contact pressure P (g/cm), wherein $10 \leqq P \leqq 60$.

2. An apparatus according to claim 1, wherein said rubber blade is of silicone rubber having a rubber hardness of not less than 10 degrees and not more than 55 degrees.

3. An apparatus according to claim 2, wherein the silicone rubber contains filler material of 5–20% by weight.

4. An apparatus according to claim 1, wherein said rubber blade has a free end in an upstream side with respect to a movement direction of said developer carrying member.

5. An apparatus according to claim 1, wherein the following is satisfied:

$$0.5 \leqq NE \leqq 3.5, \text{ and}$$

$$15.0 \times NE - 12.5 \leqq P \leqq 26.7 \times NE + 6.6$$

where NE is a distance (mm) between a free end and a most upstream position of contact between said rubber blade and said developer carrying member.

6. An apparatus according to claim 1, wherein the developer is a one component developer having an MI value of 3–30, and a weight average particle size of 3.5–7.0 microns.

7. An apparatus according to claim 1, wherein said regulating member regulates an amount of the developer to W ($mg/cm^2$ wherein $0.6 \leqq W \leqq 1.5$.

8. An apparatus according to claim 1, wherein said developer carrying member has a surface resin layer containing electroconductive material, and a surface of said layer thereof has a center line average roughness Ra (micron), wherein $0.6 \leqq Ra \leqq 1.4$.

9. An apparatus according to claim 1, wherein said apparatus constitutes together with the image bearing member a cartridge which is detachably mountable relative to an image forming apparatus.

10. An apparatus according to claim 1, wherein said developer carrying member is supplied with an alternating voltage.

* * * * *

UNITED STATES PATENT AND TRADEMARK OFFICE

CERTIFICATE OF CORRECTION

PATENT NO. : 6,058,284
DATED : May 2, 2000
INVENTOR(S) : Keiji OKANO, et al.

It is certified that error appears in the above-identified patent and that said Letters Patent is hereby corrected as shown below:

ON THE COVER PAGE,

COLUMN 1:
At Section [54]
"DEVELOPING APPARATUS" should read--A DEVELOPING APPARATUS FEATURING A REGULATING MEMBER HAVING A PRESCRIBED WEAR INDEX AND CONTACT PRESSURE ASPECTS--.

Line 17, "ers 1" should read --ers,--.

COLUMN 2:

Line 17, "developer," should read --a developer,--.

COLUMN 6:

Line 44, "will to" should read --will--.

COLUMN 7:

Line 5, "verifics" should read --verified--.
Line 10, "may" should read --may appear--.

UNITED STATES PATENT AND TRADEMARK OFFICE

CERTIFICATE OF CORRECTION

PATENT NO. : 6,058,284
DATED : MAY 2, 2000
INVENTOR(S) : Keiji OKANO, et al.

It is certified that error appears in the above-identified patent and that said Letters Patent is hereby corrected as shown below:

COLUMN 7 (con't.):

Line 57, "TMe" should read --The--.

COLUMN 12:

Line 11, "developer;" should read --developer; and--.
Line 43, "(mg/cm$^{2}$" should read --(mg/cm$^{2}$),--.

Signed and Sealed this

Tenth Day of April, 2001

Nicholas P. Godici

*Attest:*

NICHOLAS P. GODICI

*Attesting Officer*

*Acting Director of the United States Patent and Trademark Office*